US006679175B2

(12) United States Patent
Gavrilovic

(10) Patent No.: US 6,679,175 B2
(45) Date of Patent: Jan. 20, 2004

(54) CARTRIDGE AND METHOD FOR SMALL CHARGE BREAKING

(75) Inventor: Mihailo Gavrilovic, Denver, CO (US)

(73) Assignee: Rocktek Limited, Pinjarra (AU)

( * ) Notice: Subject to any disclaimer, the term of this patent is extended or adjusted under 35 U.S.C. 154(b) by 32 days.

(21) Appl. No.: 09/909,493

(22) Filed: Jul. 19, 2001

(65) Prior Publication Data

US 2003/0015112 A1 Jan. 23, 2003

(51) Int. Cl.[7] ..... F42D 3/00; F42B 3/00

(52) U.S. Cl. ..... 102/302; 102/306; 102/312; 102/313

(58) Field of Search ..... 102/302, 303, 102/306, 307, 312, 313

(56) References Cited

U.S. PATENT DOCUMENTS

| | | | | |
|---|---|---|---|---|
| 1,189,011 | A | 6/1916 | Smith | |
| 1,479,070 | A | 1/1924 | Harris | |
| 1,491,661 | A | 4/1924 | Bayat | |
| 1,616,048 | A | 2/1927 | Holt | |
| 1,896,817 | A | 2/1933 | Heitzman | |
| 2,725,821 | A | 12/1955 | Coleman | 102/22 |
| 2,759,417 | A | 8/1956 | O'Neill | 102/20 |
| 2,812,712 | A | 11/1957 | Ashurst | 102/30 |
| 2,980,019 | A | 4/1961 | Noddin | 102/28 |
| 3,003,419 | A | 10/1961 | Fite | 102/86.5 |
| 3,134,329 | A | 5/1964 | Zeman | 102/28 |
| 3,144,827 | A | 8/1964 | Boutwell | 102/39 |
| 3,264,990 | A | 8/1966 | Betts | 102/28 |
| 3,264,991 | A | 8/1966 | Betts et al. | 102/28 |
| 3,272,127 | A | 9/1966 | Betts et al. | 102/70.2 |
| 3,307,445 | A | 3/1967 | Stadler et al. | 86/20 |
| 3,313,234 | A | 4/1967 | Mohaupt | 102/20 |
| 3,604,355 | A | 9/1971 | Greenless | 102/39 |
| 3,640,223 | A | 2/1972 | Olsson | 102/28 |
| 3,999,484 | A | 12/1976 | Evans | 102/28 |
| 4,470,352 | A | 9/1984 | Leperre | 102/333 |
| 4,615,268 | A | 10/1986 | Nakano et al. | 102/217 |
| 4,669,383 | A | 6/1987 | Penner | 102/202 |
| 4,685,396 | A | 8/1987 | Birse et al. | 102/206 |
| 4,754,705 | A | 7/1988 | Worsey | 102/333 |
| 4,809,612 | A | 3/1989 | Ballreich et al. | 102/466 |
| 4,869,171 | A | 9/1989 | Abouav | 102/215 |
| 4,884,506 | A | 12/1989 | Guerreri | 102/200 |
| 4,886,126 | A | 12/1989 | Yates, Jr. | 175/4.54 |
| 5,000,516 | A | 3/1991 | Kolle et al. | 299/16 |

(List continued on next page.)

FOREIGN PATENT DOCUMENTS

| | | |
|---|---|---|
| AU | 8546/22 | 8/1922 |
| AU | 19834/24 | 9/1924 |
| AU | 100512 | 3/1933 |
| AU | 102008 | 12/1933 |
| AU | 20577/34 | 12/1934 |
| AU | 21197/35 | 2/1935 |
| AU | 21648/35 | 3/1935 |
| AU | 22195/35 | 4/1935 |
| AU | 481166 | 3/1938 |
| AU | 34081/68 | 8/1969 |

(List continued on next page.)

OTHER PUBLICATIONS

Young et al, Controlled Fracture Techniques for Rapid Excavation, Phase II, Final report, Sunburst Recovery, Inc., Report No. BSD–TR–89–31, Jun. 16, 1989.*

(List continued on next page.)

*Primary Examiner*—Peter A. Nelson
(74) *Attorney, Agent, or Firm*—Sheridan Ross P.C.

(57) ABSTRACT

The present invention is directed to a cartridge that includes a number of advantageous features. For example, the cartridge can include a bulk energetic material, an igniter located in a central portion of the cartridge body, and a low void space in the cartridge.

33 Claims, 12 Drawing Sheets

U.S. PATENT DOCUMENTS

| | | | | | |
|---|---|---|---|---|---|
| 5,033,390 | A | | 7/1991 | Minert et al. | 102/530 |
| 5,052,301 | A | | 10/1991 | Walker | 102/202.7 |
| 5,069,130 | A | | 12/1991 | Buckley et al. | 102/202 |
| 5,090,321 | A | | 2/1992 | Abouav | 102/200 |
| 5,098,163 | A | | 3/1992 | Young | 299/13 |
| 5,247,886 | A | | 9/1993 | Worsey | 102/312 |
| 5,253,586 | A | | 10/1993 | Worsey | 102/313 |
| 5,308,149 | A | | 5/1994 | Watson et al. | 299/13 |
| 5,452,661 | A | | 9/1995 | Neff | 102/202.7 |
| 5,474,364 | A | | 12/1995 | Ruzzi et al. | 299/13 |
| 5,573,307 | A | | 11/1996 | Wilkinson et al. | 299/14 |
| 5,611,605 | A | | 3/1997 | McCarthy | 299/13 |
| 5,705,768 | A | * | 1/1998 | Ey | 102/307 |
| 5,710,390 | A | | 1/1998 | Ofca | 102/275.4 |
| 5,714,712 | A | | 2/1998 | Ewick et al. | 102/311 |
| 5,765,923 | A | | 6/1998 | Watson et al. | 299/13 |
| 5,789,694 | A | | 8/1998 | Mey | 86/20.15 |
| 5,803,550 | A | | 9/1998 | Watson et al. | 299/13 |
| 5,803,551 | A | | 9/1998 | McCarthy | 299/13 |
| 6,035,784 | A | | 3/2000 | Watson | 102/313 |
| 6,145,933 | A | | 11/2000 | Watson et al. | 299/13 |
| 6,148,730 | A | | 11/2000 | Watson | 102/313 |
| 6,321,655 | B1 | | 11/2001 | Tota et al. | 102/302 |
| 6,332,401 | B1 | | 12/2001 | Tota et al. | 102/303 |
| 6,339,992 | B1 | | 1/2002 | Watson | 102/312 |
| 6,347,837 | B1 | | 2/2002 | Watson et al. | 299/13 |

FOREIGN PATENT DOCUMENTS

| | | |
|---|---|---|
| AU | 71742/74 | 1/1976 |
| DE | 628934 | 4/1936 |
| DE | 949633 | 9/1956 |
| DE | 911869 | 11/1962 |
| EP | 0109067 | 11/1983 |
| WO | WO 95/28551 | 10/1995 |
| WO | WO99/24776 | 5/1999 |

OTHER PUBLICATIONS

U.S. patent application Ser. No. 09/794,202, Tota, filed Feb. 26, 2001.

U.S. patent application Ser. No. 09/909,493, Gavrilovic, filed Jul. 19, 2001.

U.S. patent application Ser. No. 09/710,497, Watson, filed Nov. 10, 2000.

U.S. patent application Ser. No. 09/173,876, Micke, filed Oct. 16, 1998.

RocKracker from RockTek USA Ltd.; *Shooting Oversize Couldn't be Easier*!.

RocKracker; *The Simple Rockbreaking System from RockTek USA Ltd.*

Daveyfire inc.; *Product Reference System*; 1–3.

Daveyfire inc.; *N Series Fusehead*; 1–7.

Daveyfire inc; *Home Product Reference System Initiation Devices*; 1–4.

Persson et al.; 1993; *Rock Blasting and Explosives Engineering*; 56 and 400–401.

Bulletin from AECI Explosives & Chemicals Ltd., "Explosives Today", Series 2, No. 5, Jan. 1977.

McAdam & Westwater, "Mining Explosives," pp. 12–15.

Bulletin from AECI Explosives & Chemicals Ltd., "Explosives Today", Series 2, No. 46, Jun. 1987.

Bulletin from AECI Explosives & Chemicals Ltd., "Explosives Today", Series 2, No. 36, 2nd Quarter 1984.

AECI Explosives & Chemicals Ltd. Catalogue of Explosives and Accessories.

Young, Watson, & Levien, "Full–Scale Testing of the PCF Rock Excavation Method", Australian Tunnelling Conference, Aug. 1993.

Young & Dick, "Controlled Fracture Techniques for Rapid Excavation–Phase II Final Report", Jun. 16, 1989.

Young, Dick, & Foumey, "Small–charge Cone–fracture Technique for Rapid Excavation", Fragblast 90, Aug. 1990.

Pearson, "Continuous Resue Stoping", Gold Mining on the Witaters Rand, vol. 1, 1946.

Bock, Jagger, & Robinson, "An economic model for gold and plantinum mining using selective blast mining", Journal of the South African Institute of Mining and Metallurgy, Mar./Apr. 1998.

Lewis, "Elements of Mining" 1941, Chapter V, pp. 96–103.

Brinkmann, "Blasting Technology in Stoping and Development", Saimm School Feb. 1986.

Bulletin from AECI Explosives & Chemicals Ltd., "Explosives Today", Series 2, No. 45, Mar. 1987.

Peele & Church, "Mining Engineer's Handbook" 1918, pp. 4–19–4–25.

Swartklip Products, "Hydro–fracturing, Rock Breaking Technology", Jul. 29, 1998.

* cited by examiner

FIG. 2A
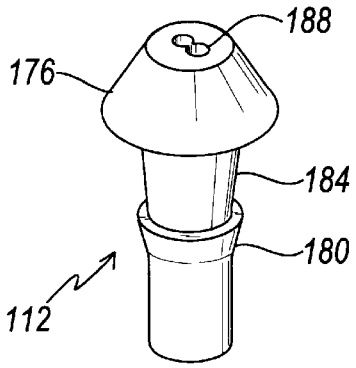
FIG. 3A
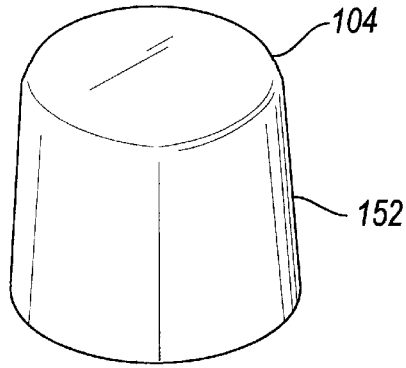
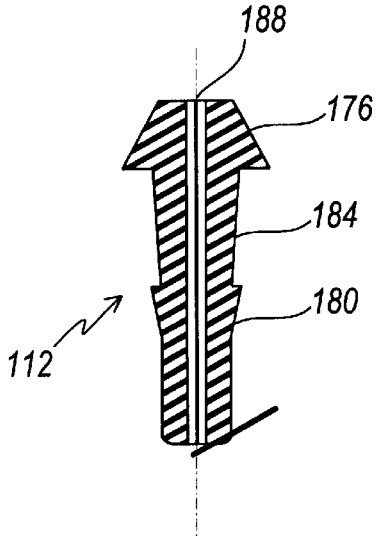
FIG. 2C
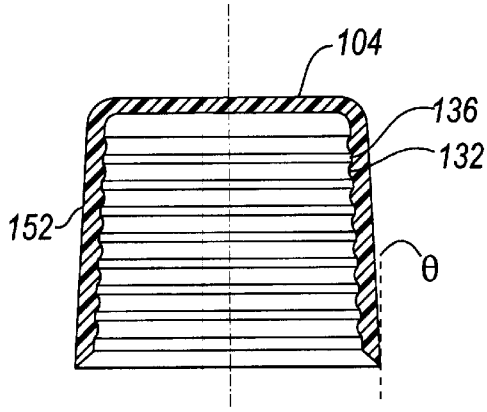
FIG. 3C
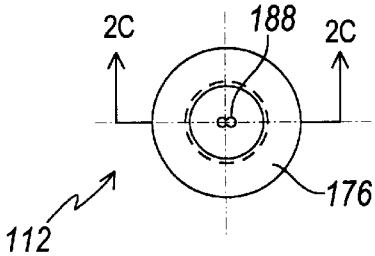
FIG. 2B
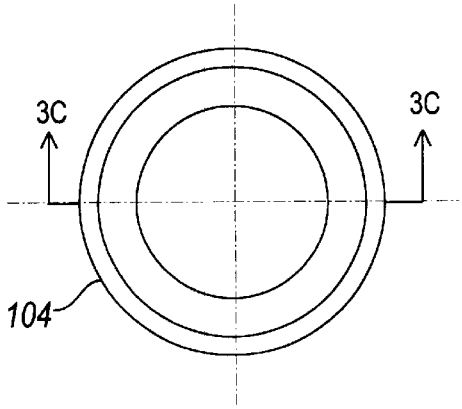
FIG. 3B FIG. 7A
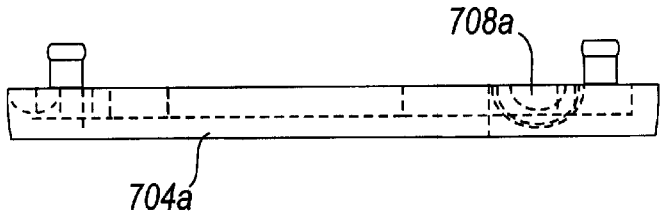
FIG. 7B
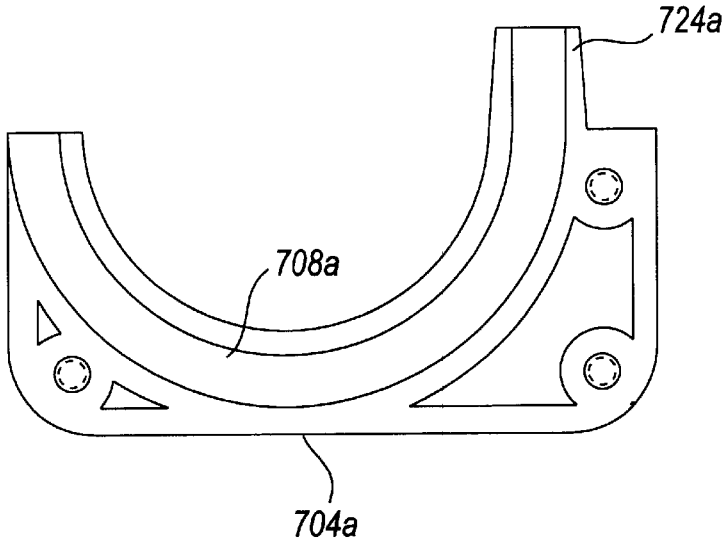
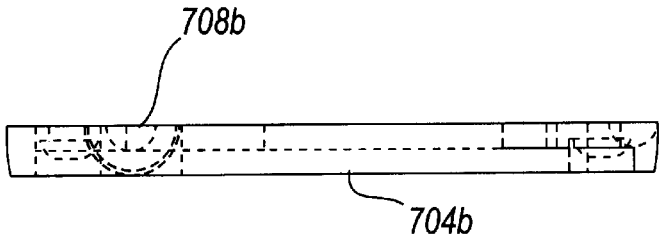
FIG. 8A
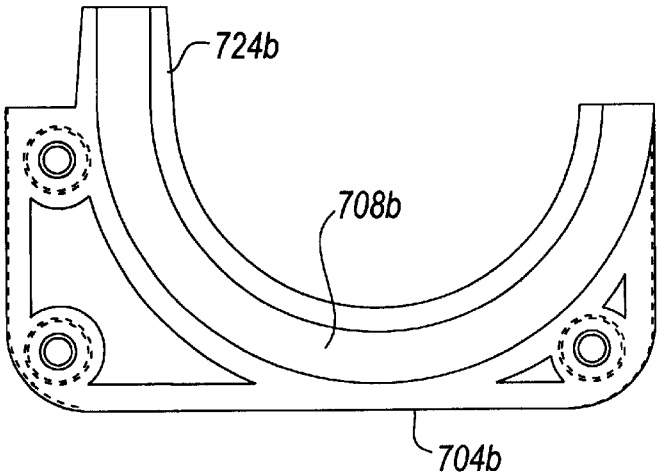
FIG. 8B

CARTRIDGE AND METHOD FOR SMALL CHARGE BREAKING

FIELD OF THE INVENTION

The present invention is directed generally to a cartridge and method for breaking and specifically to a cartridge and method for small charge breaking of rock, concrete and other materials.

BACKGROUND OF THE INVENTION

Small charge breaking has become an important mining technique in recent years compared to conventional breaking due to the reduced toxic gaseous emissions in the mine (which enables the excavation face to be cleared of such emissions rapidly), increased personnel safety due to the use of smaller amounts of energetic materials (and less flyrock), and the ability to have personnel remain safely in the excavation in the general vicinity of the excavation face during breakage.

In a typical small charge breaking process, a hole is formed in the material to be excavated. One or more small charge cartridges are placed into the bottom or toe of the hole, and the hole is stemmed with a suitable material. The stemming material can be a stemming member such as a massive bar and/or a particulate stemming material such as gravel. When the energetic material in the cartridge is initiated, there is a rapid generation of gas and thus a rapid build up of gas pressure near the toe of the hole. Provided that the gas generated is contained for a short period of time, the resulting gas pressure may cause fractures to be propagated from the hole through the material.

A number of problems have been encountered during small charge breaking. By way of example, a relatively high occurrence of misfires has been experienced. The misfires are believed to be due to a number of factors, including water egress into the cartridges and subsequent damage of cartridge components and igniter damage and/or lead breakage during insertion of the cartridge into the hole. Small charge breaking has been relatively inefficient due to an unacceptably low rate of pressure rise in the hole and/or unacceptably high rate of gas loss from the hole due to inefficient sealing of the hole. Small charge breaking cartridges have been relatively expensive to ship due to stringent regulations governing explosive materials. Such costs have significantly increased small charge breaking costs. To mitigate such costs, some cartridge manufacturers have separately shipped the cartridge in parts which are then assembled at the excavation site. Such on-site assembly has had mixed success due to the relative complexity of the cartridge design and the consequent quality control problems. Further problems have been encountered with small charge breaking cartridges "binding" or getting stuck in the holes during cartridge insertion. Finally and relatedly, it has been extremely difficult to remove misfired cartridges from the hole, thereby endangering personnel.

SUMMARY OF THE INVENTION

These and other needs are addressed by the various embodiments of the present invention. The cartridge includes a number of advantageous features that individually and collectively provide a highly efficient and robust small charge breaking system.

In one embodiment, a small charge breaking system is provided that includes the following:

(a) a cartridge including:
  (i) a housing;
  (ii) a bulk energetic material contained in the housing, the bulk energetic material filling at least most of the volume enclosed by the housing; and
  (iii) a high energy igniter operatively disposed relative to the bulk energetic material such that the igniter can initiate the low energy energetic material;

(b) a hole extending into a material to be broken by the bulk energetic material; and (c) a stemming material positioned between the cartridge and an opening of the hole. The stemming material impedes the escape from the hole of gas released by the bulk energetic material after initiation of the bulk energetic material.

The bulk material can be any suitable energetic material, preferably releasing no more than about 1 megajoules/kg/millisecond and preferably deflagrating rather than detonating. The bulk material can be an explosive or nonexplosive material such as a propellant. Preferred materials include nitrocellulose, nitroglycerine, nitroguanadine, and mixtures thereof. When the bulk material is a propellant, the propellant will typically have a bum rate, in the cartridge, of no more than about 5 mm/second of propellant grain.

The high energy igniter can be of any suitable design. The igniter can be electronic, electric or nonelectric, can be adapted to incorporate electronic timing mechanisms to effectuate downhole delay, and can employ an initiator energetic material, such as a secondary energetic material, a pyrotechnic, or any combination of the foregoing. The igniter can include a microprocessor, timer, and memory to process commands regarding initiation delay time. Preferably, the high energy igniter, after initiation, releases a total amount of energy of at least about 250 joules and more preferably at least about 500 joules and even more preferably at least about 750 joules into the bulk energetic material. In one configuration, the igniter includes a pyrotechnic material, such as boron calcium chromate titanium ("BCTK") potassium percarborate and is otherwise free of a primary or secondary energetic material. An example of such an igniter is disclosed in U.S. Pat. No. 5,710,390, which is incorporated herein by this reference. The high energy initiation preferably deflagrates and does not detonate. As will be appreciated, a detonator will have a poor ability to initiate a granular bulk energetic material such as a propellant.

In one configuration, a synergistic combination of the high energy igniter with a bulk energetic material that includes ammonium nitrate and a double based propellant provides unexpectedly effective results.

The stemming material can be any nonenergetic material that is stable under the conditions present in the hole during initiation and consumption of the bulk energetic material. The stemming material can be a consolidated material, such as a resin, a water-based gel, cementitious material, grout, concrete, metal or composite bar, and clay and/or an unconsolidated material, such as gravel, sand, and dirt. In one configuration, a stemming member is used to hold an unconsolidated stemming material in the hole. The unconsolidated stemming material has been found to absorb shock from the initiation of the cartridge and thereby protect the stemming member from damage.

To provide a low incidence of misfires and more efficient combustion of the bulk energetic material, the "hot end" of the high energy igniter is preferably disposed in a portion of the bulk energetic material located in a middle section of the housing and spaced from opposing ends of the cartridge. The "hot end" of the igniter refers to the end of the igniter from which a flame is emitted during initiation. The igniter is configured to "shoot" a flame forward into the (bulk) propellant, resulting in a linear ignition rather than a point initiation. While not wishing to be bound by any theory, it is believed that, when the igniter is initiated, dual flame fronts propagate towards the opposing ends of the cartridge. By positioning the hot end of the cartridge in the middle of the cartridge, both flame fronts can simultaneously consume large amounts of the bulk energetic material, resulting in relatively high rates of pressure increase in the cartridge body and in the hole with concomitant high rates of rock breakage per cartridge compared to conventional cartridge designs. Preferably, the igniter preferably shoots the flame forward into the low energy secondary material. Preferably, the hot end of the igniter is positioned at least about 20% and more preferably from about 30% to about 50% of the cartridge length from the proximal (or distal) end of the housing.

In another embodiment, a cartridge is provided that includes:

(a) a housing having proximal, middle, and distal sections disposed along a length of the cartridge, the middle section being between the proximal and distal sections;

(b) a bulk energetic material contained in at least the middle section of the housing, the bulk energetic material filling at least most of the volume enclosed by the middle section of the housing; and (c) an igniter operatively disposed relative to the bulk energetic material such that the igniter can initiate the energetic material. The igniter is positioned entirely in the middle section of the housing.

In one configuration, the housing has a body and opposing end caps. The end caps are discrete from the body. The end caps are removably attached to the body such that the end caps will separate from the body in the event of accidental ignition of the bulk energetic material.

To provide initial containment of the gases during combustion of the energetic material, the housing or cartridge body is preferably formed from a rigid or semi-rigid waterproof or water resistant material. Having too rigid or strong a cartridge housing, though desirably providing a high degree of initial confinement of the gas generated by combustion of the bulk energetic material, can cause higher risks of injury to personnel during cartridge transportation and result in compliance with more stringent regulations and therefore higher shipping costs. Having too flexible or weak a cartridge housing, though desirably providing a higher degree of safety and lower shipping costs due to compliance with less stringent regulations, provides poor initial gas confinement and less efficient rock breakage. Preferably, the cartridge housing material has a yield strength of at least about 500 psi and no more than about 3000 psi. Preferably, the cartridge can withstand external pressures of up to about 25 psi.

To provide effective sealing from downhole liquids such as water and consequent lower misfire rates and lower risks of other performance problems, engagement surfaces between one or both of the end caps and the body can contain multiple interlocking sealing surfaces. In one configuration, the interlocking sealing surfaces are serrated or undulating in profile.

To provide ease of assembly and maximize the amount of energetic material that can be placed in the housing, one or both of the end caps preferably fits over the corresponding mating surface of the body section.

To provide ease of insertion into the hole and permit removal of the cartridge from the hole in the event of a misfire, the exterior surface of one or both of the end caps is tapered away from the body section and the edges of the caps are rounded or arcuate. In other words, a distal end of the end cap has a smaller periphery than a proximal end of the end cap adjacent to the body section to define a frustoconical surface. The cartridge has a shorter effective length when inserted into the hole, has lower risks of being bound in the hole during insertion due to irregularities in hole width and/or bearing, can be readily autoloaded or mechanically loaded into the hole, and can be easily removed from the hole by a suitable downhole tool in the event of misfire (as the uphole end cap has sufficient clearance relative to the walls to permit a downhole tool to grip the cap).

To facilitate placement and alignment of multiple cartridges in the hole, a joiner sleeve can be employed. The joinder sleeve fits between and engages simultaneously adjacent downhole cartridges.

To protect the activator to the igniter from damage particularly during insertion of the cartridge into the hole, the housing can include a groove extending at least most of the length of the cartridge for receiving the activator or lead to the igniter, when the activator enters the cartridge in a downhole end of the cartridge. The groove can be have an arcuate or radiused portion that wraps around an end of the cartridge. The activator can be of any suitable configuration, such as a twisted wire, a (nonelectric) shock tube, and a circular section single or pair electrical cable.

To further protect the igniter from undesirable displacement in the cartridge body during insertion, the activator can enter an end of the housing at an entry hole that is located off-center relative to a longitudinal center axis of the cartridge. To seal against downhole liquids, a pliable waterproof or water resistant seal can be inserted into the entry hole to receive the activator.

In yet another embodiment, a small charge breaking method is provided that includes the steps of:

(a) providing a cartridge of any of the configurations described above;

(b) inserting the cartridge into a hole extending into a material to be broken by the bulk energetic material;

(c) inserting a stemming material into the hole such that the stemming material is positioned between the cartridge and an opening of the hole; and (d) igniting the igniter to cause initiation of the bulk energetic material.

In yet another embodiment of the present invention, a method for manufacturing a cartridge for small charge breaking, comprising:

(a) at least substantially filling a cartridge housing with a bulk energetic material;

(b) locating an igniter in a middle portion of the cartridge housing;

(c) positioning a lead to the igniter along a groove extending a length of the cartridge housing; and (d) engaging an end cap with an open end of the cartridge housing. The above steps can be performed at the excavation site.

The above summary is intended to be neither complete nor exhaustive. Other embodiments of the invention are obvious to one of ordinary skill in the art based on the teachings in the present application. Such other embodiments are intended to be included within the scope of the present invention.

BRIEF DESCRIPTION OF THE DRAWINGS

FIG. 2A is a perspective view of a rubber seal in the cartridge;

FIG. 2B is a top view of the rubber seal;

FIG. 2C is a cross-sectional view of the rubber seal along line 2C—2C of FIG. 2B;

FIG. 3A is a perspective view of a proximal cap of the cartridge;

FIG. 3B is a plan view of the inside of the proximal cap;

FIG. 3C is a cross-sectional view of the proximal cap along line 3C—3C of FIG. 3B;

FIG. 7A is a side view of a left side of a cartridge clip according to the second embodiment;

FIG. 7B is a plan view of the left side;

FIG. 8A is a side view of a right side of the cartridge clip;

FIG. 8B is a plan view of the right side;

DETAILED DESCRIPTION

Figure 1A:
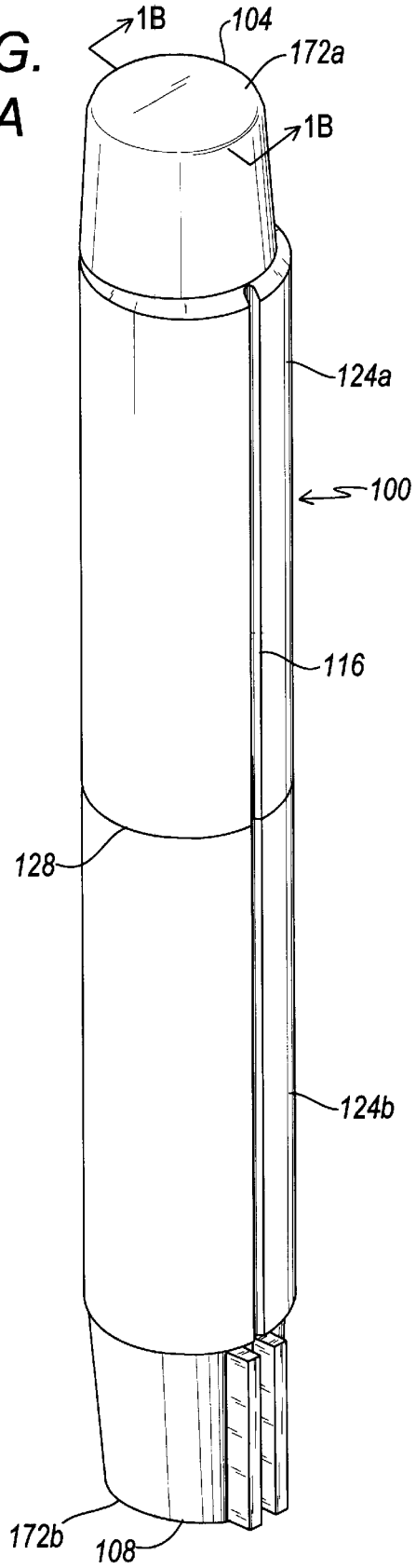
FIG. 1A is a perspective view of a cartridge according to a first embodiment of the present invention.
Figure 1B:
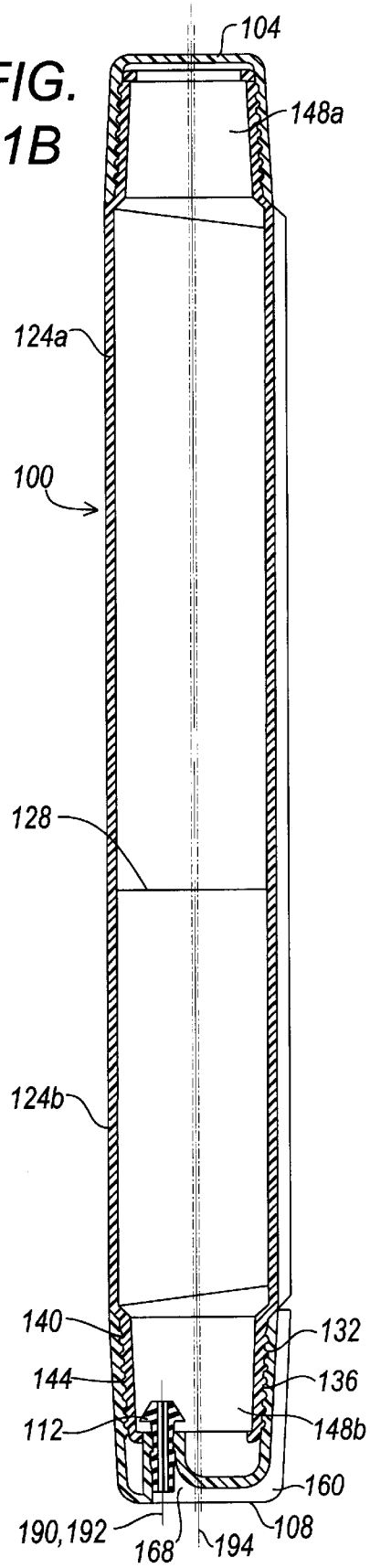
FIG. 1B is a cross-sectional view of the cartridge, when empty, along line 1B—1B of FIG. 1A.
Figure 4A:
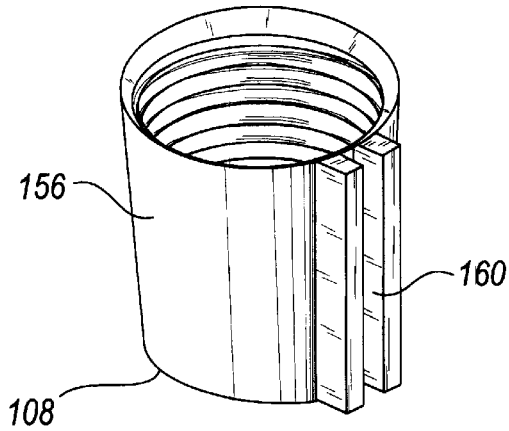
FIG. 4A is a perspective view of a distal cap of the cartridge.
Figure 4C:
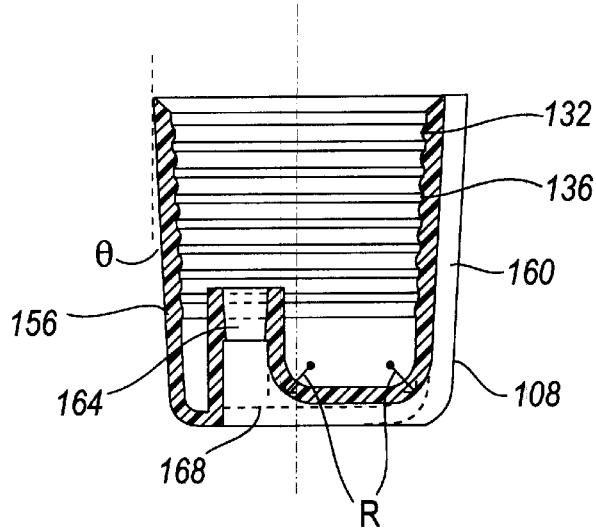
FIG. 4C is a cross-sectional view of the distal cap along line 4C—4C of FIG. 4B.
Figure 4B:
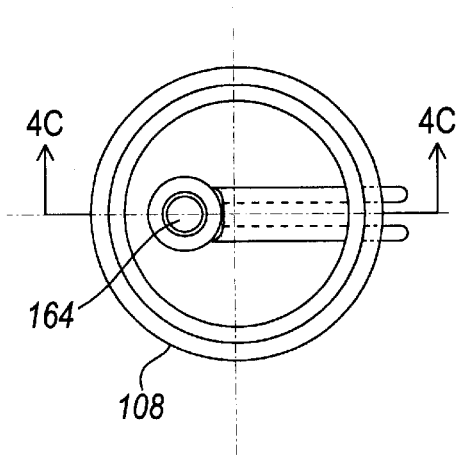
FIG. 4B is a plan view of the inside of the distal cap.

A first embodiment of a cartridge is depicted in FIGS. 1A, 1B, and 165. The cartridge includes a cartridge body 100, proximal end cap 104, distal end cap 108, and seal 112.

Figure 11:
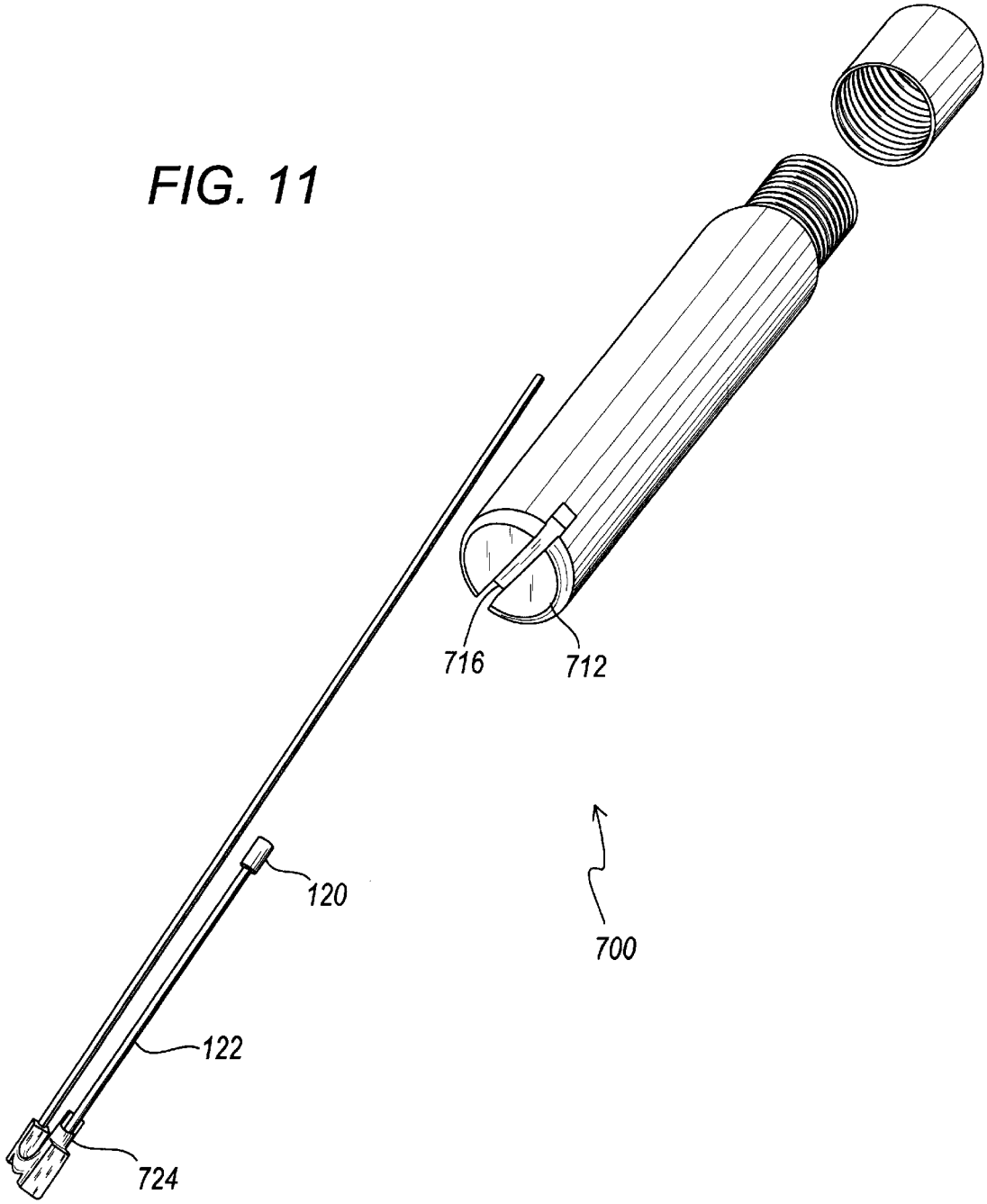
FIG. 11 is a disassembled view of the cartridge.

The cartridge body 100 includes a longitudinal channel 116 running substantially the length of the body for receiving a lead, tube or other type of activator 122 (FIG. 11) for an initiator 120 (FIG. 11) located inside of the cartridge. The channel 116 prevents the activator from being damaged during cartridge assembly and/or insertion into the hole, thereby reducing misfires. As will be appreciated, cartridge body 100 can be molded as a one-piece cartridge body.

The cartridge body 100 includes first and second sections 124*a,b*, which are joined together at seam 128 by any suitable technique to prevent water ingress into the cartridge interior. Examples of suitable techniques include a hot plate, adhesive, matching threads, and the like. The two sections are aligned during assembly to form the continuous longitudinal groove or channel 116 noted above for the activator.

The proximal and distal end caps 104, 108 include ridges 132 and grooves 136 which match and interlock with annular ridges 140 and grooves 144 at either end 148*a,b* of the cartridge body 100. The interlocking thread-like surfaces form a water resistant seal and can be configured such that the opposing body and cap snap-or screw onto one another. As noted, the engagement between the interlocking surfaces is relatively strong but not strong enough to cause detonation of the energetic material in the event of accidental ignition or combustion. The interlocking surfaces preferably separate at a force of at least about 5 and no more than about 25 pounds.

Referring to FIGS. 3A, 3C, 4A, and 4C, the outer surfaces 152, 156 of the proximal and distal end caps 104, 108 are tapered inwardly relatively to a line defined by the outer surface of the cartridge body 100 to facilitate extraction of the cartridge body from the hole, such as in the event of misfire, and ease of insertion into the hole. Preferably, the angle θ of taper ranges from about 5 to about 30 degrees.

Distal end cap 108 includes a channel 160 (which wraps around the profile of the cap) and passage 164 for the activator. As shown in FIG. 1A, the channel 160 is aligned with channel 116 in the cartridge body to prevent pinching of the activator 122. The top portion 168 of the channel 160 protects the activator from being pinched when the distal end 172*b* of the cartridge is butted or jammed against the bottom or toe of the hole, during tamping of the cartridge in the hole. The channel 160 is radiussed to avoid pinching of the activator. Preferably, the channel 160 has a radius "R" of at least about 1.5 mm and more preferably ranging from about 1.25 to about 1.75 mm.

To provide initial containment of the gases during combustion of the energetic material, the cartridge body 100 and proximal and distal end caps 104, 108 (FIGS. 3A–C and 4A–C) are preferably formed from a rigid or semi-rigid waterproof or water resistant material. Preferably, the cartridge body and end caps are made from a material having a yield strength of at least about 500 and no more than about 3,000 psi. Suitable materials include metals and/or plastics. A particularly preferred material is polypropylene PPR 1042.

To prevent ingress of water and other downhole liquids into the cartridge interior, the flexible seal 112 (FIGS. 2A–2C) is received in the passage 164 of the distal end cap 108. The seal 112 preferably is water resistant and waterproof and has a flexibility ranging from about 70 to about 80 shore, with about 75 shore being more preferred. The preferred material is a thermoplastic material such as Alcryn. The seal 112 has flared ends 176 and 180 FIGS. 2A–2C) to hold the middle section 184 of the seal in position in passage 164. The activator is received by and passes through the central passage 188 of the seal. The flexibility of the seal 112 permits the seal to deform to receive the activator, thereby sealing out liquids.

As can be seen from FIG. 1B, the centers 190, 192 of the passage 164 and seal 112 are aligned and offset from the longitudinal axis or center 194 of the cartridge. This feature protects the igniter from undesirable displacement in the cartridge body during insertion of the cartridge into the hole and allows for a radius to prevent kinking of the activator while turning the activator 180°.

Figure 5A:
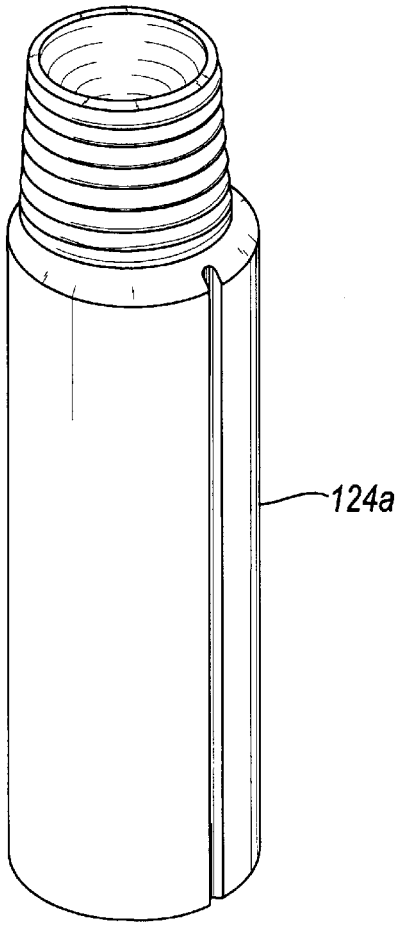
FIG. 5A is a perspective view of a section of the cartridge body.
Figure 5B:
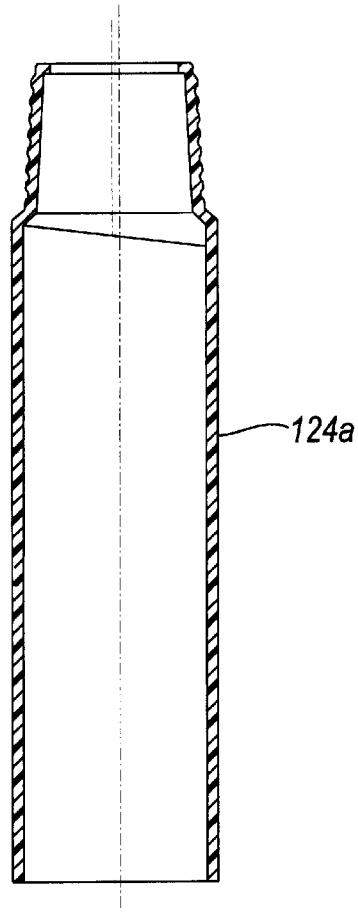
FIG. 5B is a cross-sectional view of the section of the cartridge body along line 5B—5B of FIG. 5C.
Figure 5C:
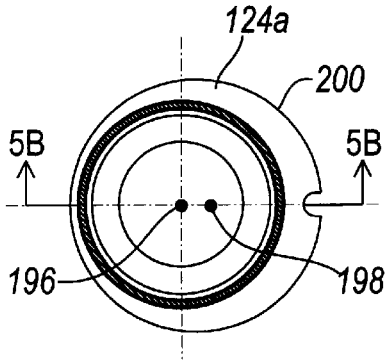
FIG. 5C is an end view of the section of the cartridge body.

As shown in FIGS. 5A–C, the centers 196*a,b* of the opposing threaded ends of the cartridge are aligned with one another and offset relative to the center 198 of the outer surface 200 of the cartridge body 100. This is so because the activator passes smoothly from the channel 116 and onto the outer surfaces of the proximal and distal caps 104, 108, thereby preventing pinching of the activator.

To provide efficient combustion of the energetic material 204 (FIG. 165), the initiator 120 is located in a middle section of the cartridge. In this position, a flame from ignition of the initiator will propagate through the energetic material towards either end 172*a,b* of the cartridge. By positioning the "hot end" (or flame producing end) 208 of the ignitor at or near the center of the column of energetic material in the cartridge (i.e., about ⅓ to about ½ of the cartridge length from either end of the cartridge), the opposing flames will reach either end of the energetic material (or either end 172*a,b* of the cartridge) at approximately the same time, thereby reducing the amount of uncombusted energetic material present after material breakage. Preferably, the hot end of the igniter is positioned at least about 20% and more preferably from about 30% to about 50% of the cartridge length "L" from the proximal (or distal) end of the housing.

Figure 15:
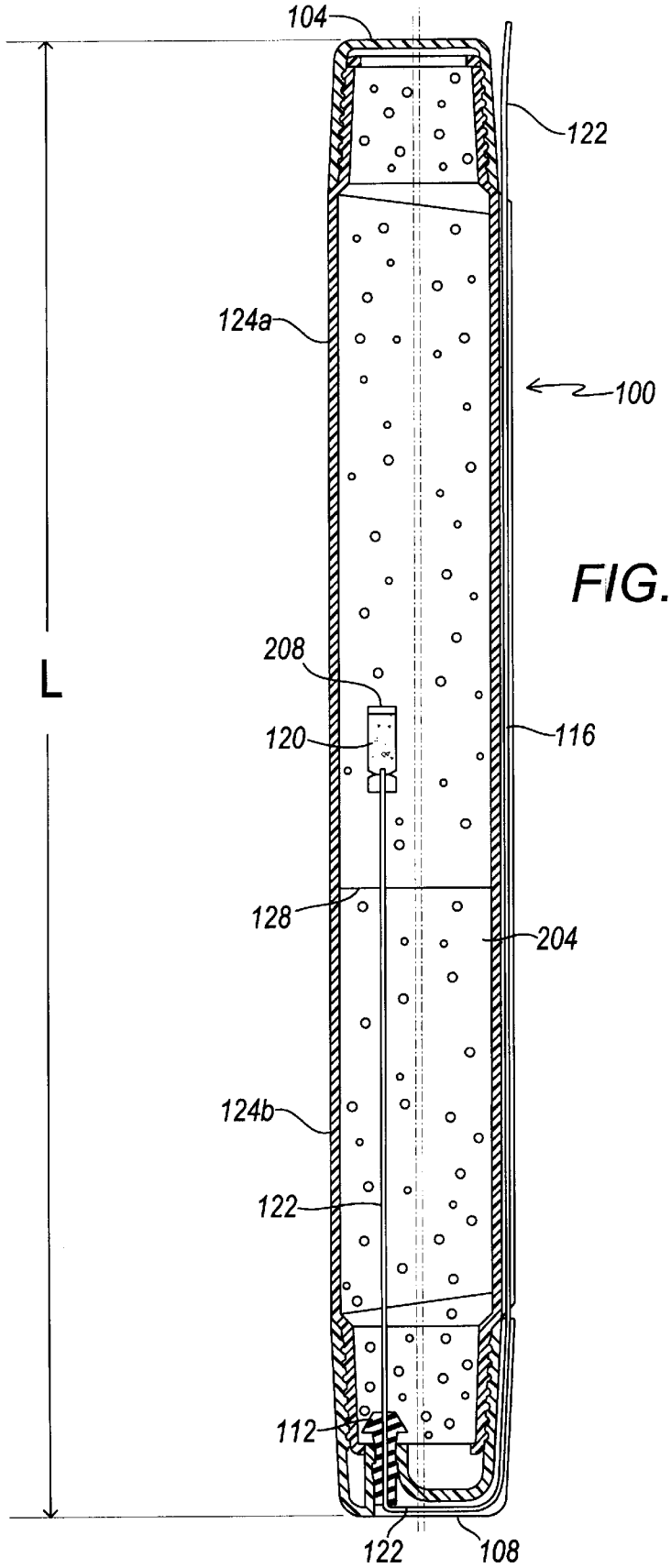
FIG. 15 is a cross-sectional view of a fully assembled, filled cartridge of the first embodiment along line 1B—1B of FIG. 1A.
Figure 16:
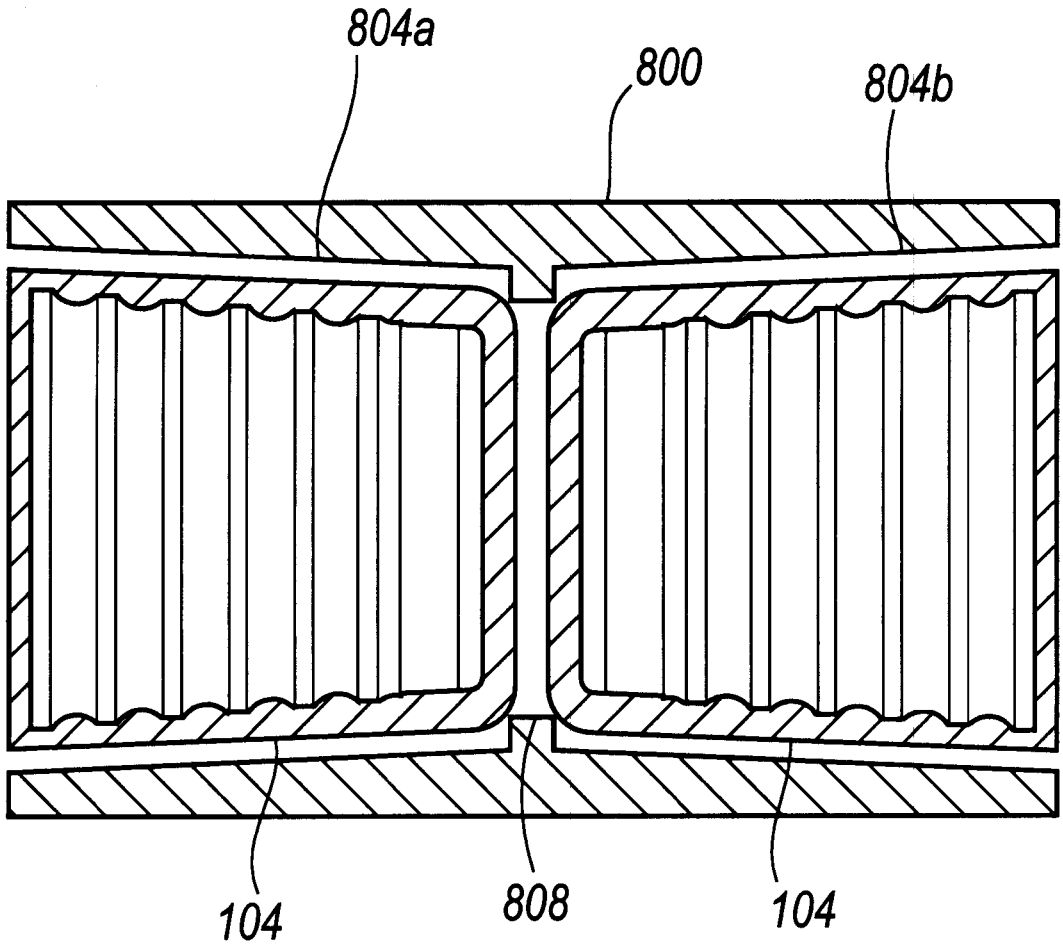
FIG. 16 is a sectional view of a joinder sleeve according to an embodiment of the present invention.

Referring to FIGS. 15 and 16, the cartridge interior includes the bulk energetic material 204. The bulk energetic material 204 can be any suitable energetic material that deflagrates. The bulk energetic material is preferably a propellant. Preferred, materials include nitrocellulose, nitroglycerine, nitroguanadine, sodium nitrate, ammonium nitrate, and mixtures thereof. When the bulk energetic material is a propellant, the propellant will typically have a bum rate, in the cartridge, of no more than about 400, more typically from about 100 to about 400, and even more typically from about 200 to about 300 mm/sec.

In a preferred configuration, the bulk energetic material includes an oxidizer such as ammonium nitrate and a double based propellant such as a nitrocellulose and nitroglycerine mixture and provides unexpectedly effective results. This mixture is disclosed in copending U.S. Provisional Application Serial No. 60/273,228 entitled "Energetic Substance and Method of Incorporating Same", filed Mar. 2, 2001, which is incorporated herein by this reference.

The igniter 120 includes an initiator energetic material which synergistically interacts with the low energy energetic material to provide unexpectedly benefits in rock breakage. Preferably, the high energy igniter, after initiation, releases an amount of energy of at least about 250 joules and more preferably ranging from about 500 to about 1500 joules. In one configuration, the igniter includes a pyrotechnic material, such as one or more of BCTK, boron, calcium chromate, titanium and potassium perchlorate, and is free of a primary or secondary energetic material.

Figure 12:
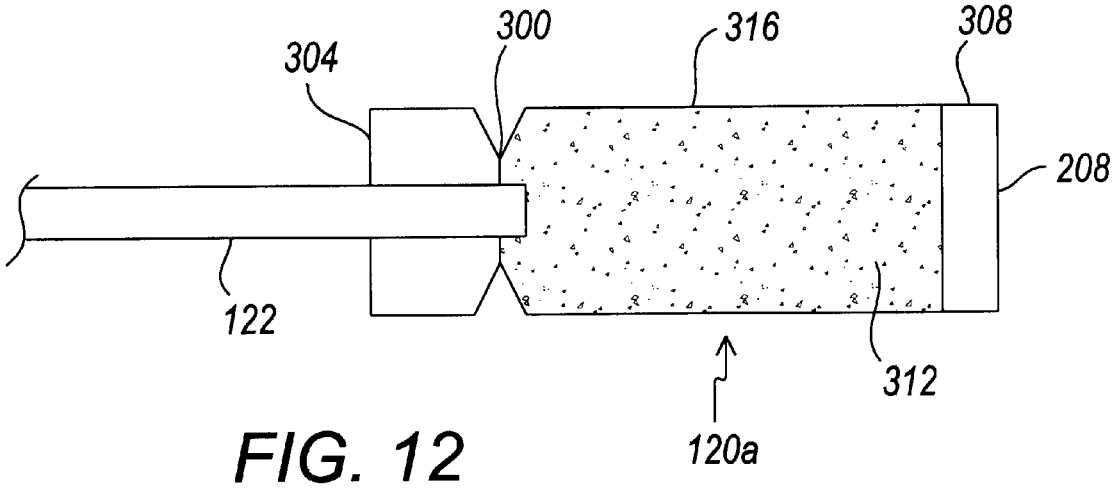
FIG. 12 is a sectional view of an initiator according to one embodiment.

Referring to FIG. 12, a first configuration of the high energy igniter 120*a* is depicted. The igniter 120*a* includes a first crimp 300 at a distal end 304 of the igniter to hold the activator (which preferably is a nonelectric shock tube or electric lead) in engagement with the igniter 120*a*. A second crimp 308 is located at the proximal or hot end 208 of the igniter to hold the initiator energetic material 312 in the igniter housing 316. The initiator energetic material 312 is preferably a pyrotechnic material, such as BCTK.

Referring again to FIG. 15, the method of manufacture of the cartridge will be described. One end of the body 100 is opened by pressing out a weakened plug. The energetic material 204 is then poured into the body 100 through the opposing, open end of the body. Typically, the volume of the body 100 is at least substantially filled with the energetic material 204 and more typically at least about 95% and even more typically from about 98 to about 100% of the volume contains energetic material. The total void space (i.e., interstitial volume and unfilled volume) in the body 100 is typically no more than about 25 and more typically ranges from about 5 to about 20 vol. %. The cartridge can be filled on a vibratory machine to ensure minimal void space is present in the cartridge interior. The engagement of the interior surface of the end cap over the exterior surface of the body provides not only ease of filling of the cartridge body but also a greater degree of filling of the cartridge body. The remaining end cap 104, 108 is then engaged with the body 100 and the cartridge transported to the job site without the igniter (if desired). The omission of the igniter 120 from the cartridge during transportation provides increased safety and decreased transportation costs due to less stringent requirements.

At the job site, the end cap 104 or 108 is removed from the body 100. The activator 122 is passed through the seal 112, and the igniter 120 located in the energetic material 204 in the body 100. The end cap 104 or 108 is then re-engaged with the body 100. The activator 122 is passed through the channels 160, 100, and the cartridge is ready for use. Alternatively, the removed end cap can be replaced with a previously assembled end cap with the igniter which has been shipped separately.

Figure 13:
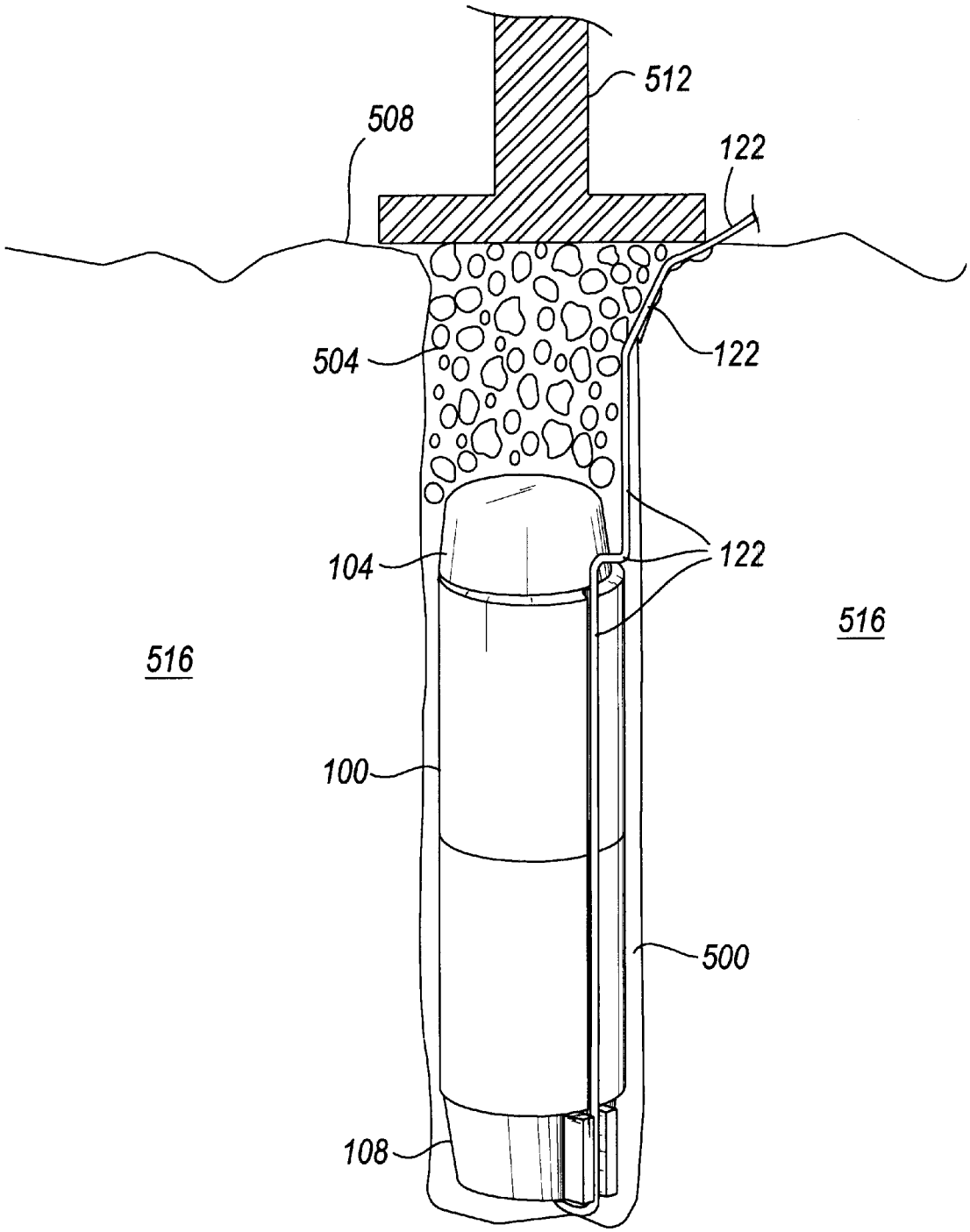
FIG. 13 is a sectional view of a cartridge stemmed in a hole.
Figure 14:
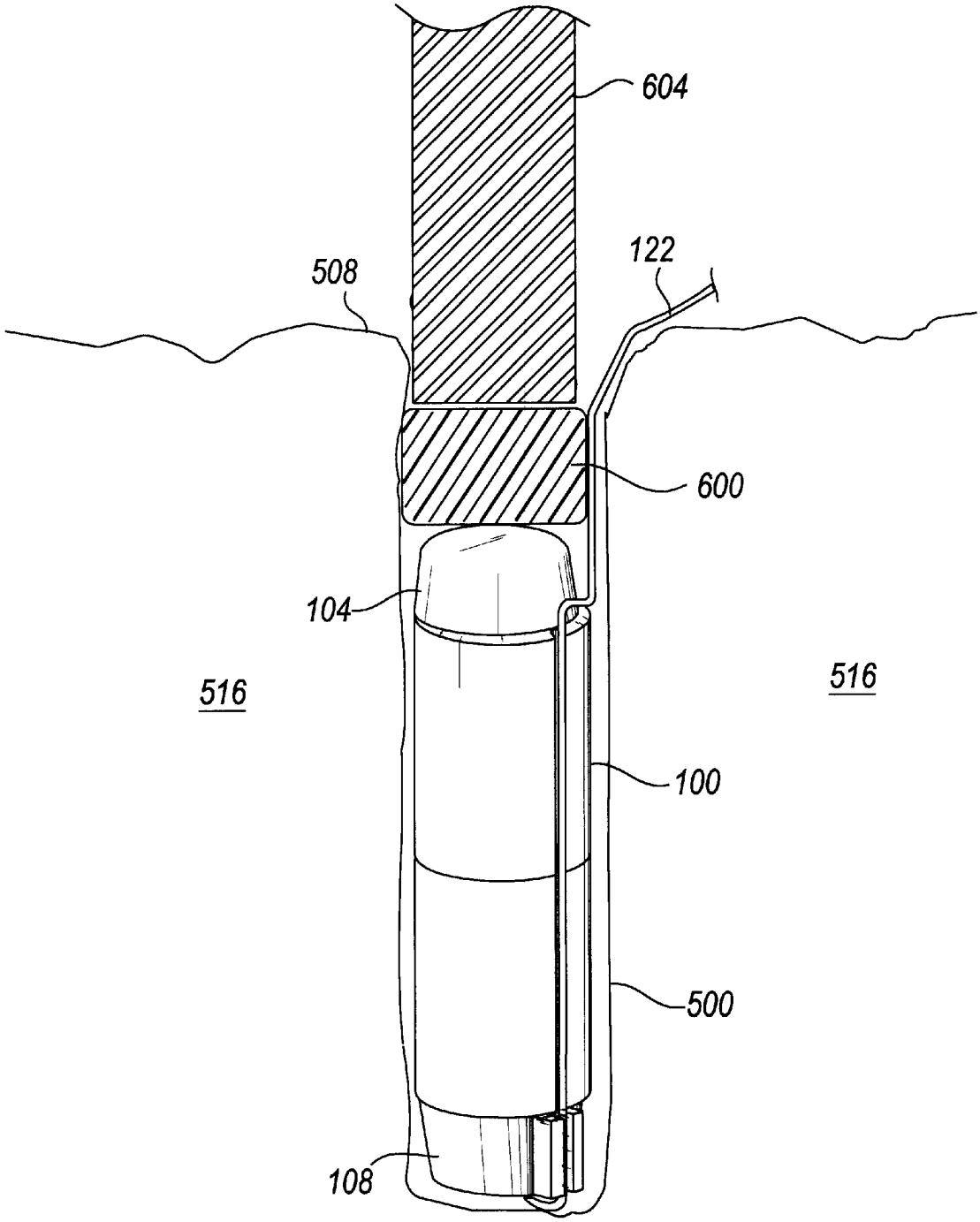
FIG. 14 is a sectional view of a cartridge stemmed in a hole.

Alternative methods of use of the cartridge are depicted in FIGS. 13 and 14. Referring to FIG. 13, the cartridge is located in the bottom of drill hole 500, with the activator 122 extending outside of the hole. A loose or unconsolidated stemming material 504 is positioned in the hole 150 between the cartridge and the collar 508 of the hole. The material 504 can be tamped and/or pneumatically loaded into the hole for better stemming performance. If necessary, a retaining member 512 (or stemming bar similar to bar 604 in FIG. 14) is held against the stemming material 504 to hold the stemming material in position during initiation of the cartridge. The cartridge is then initiated to cause fracturing of the surrounding material 516. FIG. 14 shows an alternative method of use in which the stemming material 600 is enclosed in a package and is not loose in the hole and in which the retaining member 604 is inserted into the hole.

Figure 6:
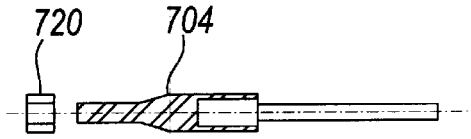
FIG. 6 is a seal according to a cartridge of a second embodiment of the present invention.
Figure 9A:
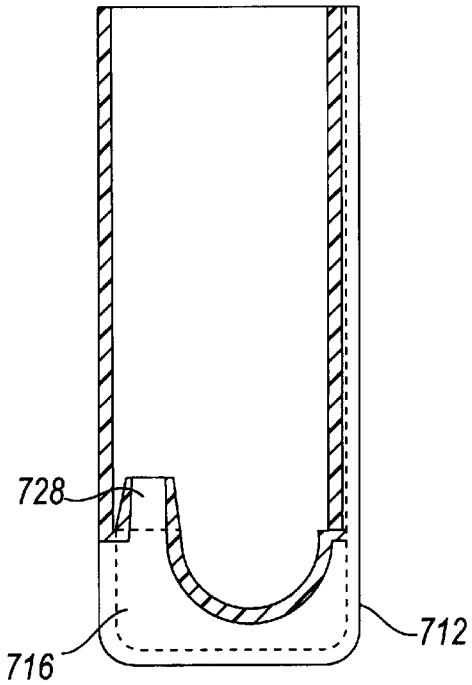
FIG. 9A is a cross-sectional view of a lower section of the cartridge body along line 9A—9A of FIG. 9B.
Figure 10A:
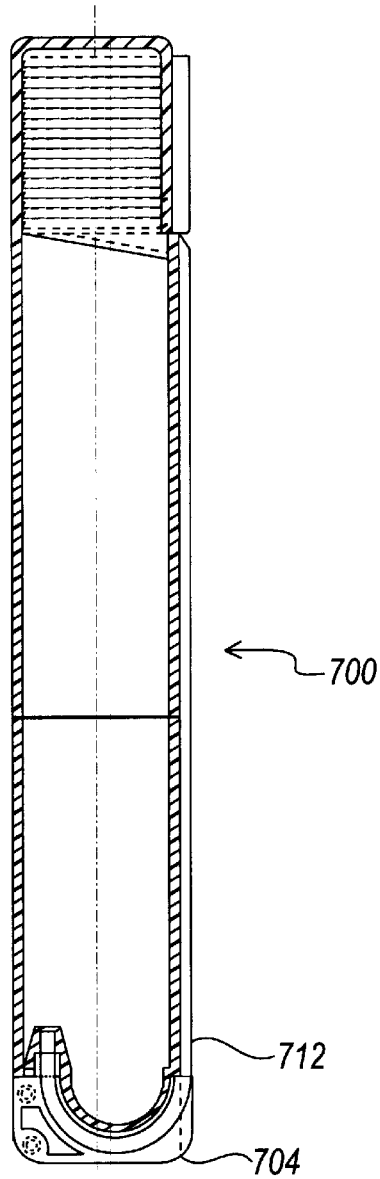
FIG. 10A is a cross-sectional view of the cartridge along line 10A—10A of FIG. 10B.
Figure 9B:
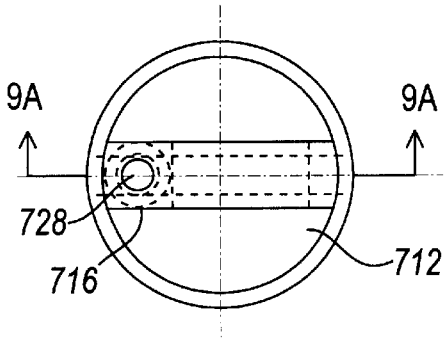
FIG. 9B is an end view of the lower cartridge body section with the cartridge clip removed.
Figure 10B:
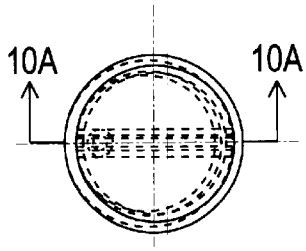
FIG. 10B is an end view of the lower cartridge body section with the cartridge clip inserted.

Referring to FIGS. 6–11, another cartridge embodiment will be discussed. The cartridge 700 includes an initiator clip 704 that engages and holds the activator 122 and initiator 120. The clip 704 includes opposing male and female segments 704*a,b* that define a channel 708 therebetween for the activator 122. The clip 704, when assembled, engages the distal end 712 of the cartridge. A slot 716 in the distal end 712 of the cartridge 700 engages the sides of the clip to hold the clip in position. Referring to FIG. 6, a flexible seal 700 can engage the insertable male end 724 of the clip 704 prior to insertion of the end 724 into female fitting 728 of the cartridge for more effective sealing of the cartridge interior from water and other fluids.

FIG. 16 shows a joinder sleeve 800 for use with the cartridge embodiments discussed above. A longitudinal cross-section of the joinder sleeve is illustrated in FIG. 16.

As can be seen from FIG. 16, the joinder sleeve 800 includes opposing annual sections 804*a,b* for engaging opposing proximal ends 104 of opposing cartridges. A spacer 808 is positioned in a central portion of the sleeve 800 to maintain a desired spacing between the opposing faces of the end caps. The joinder sleeve 800 is used in applications where more than one cartridge is to be placed in the hole. The joinder sleeve 800 maintains the cartridges in a desired orientation after location in the hole. As will be appreciated, the joinder sleeve 800 releaseably engages the cartridge for ease of use.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best modes presently known of practicing the inventions and to enable others skilled in the art to utilize the inventions in such, or in other embodiments, and with the various modifications required by their particular application or uses of the invention. It is intended that the appended claims be construed to include alternative embodiments to the extent permitted by the prior art.

What is claimed is:

1. A small charge breaking system, comprising:

a cartridge including:

a housing;

a bulk energetic material contained in the housing, the bulk energetic material filling at least most of the volume enclosed by the housing; and a high energy igniter operatively disposed relative to the bulk energetic material such that the igniter can initiate the bulk energetic material, wherein the high energy igniter, after initiation, releases a total of energy of at least about 400 joules per millisecond and wherein the bulk energetic material, after initiation, deflagrates and has a burn rate of ranging from about 100 to about 400 mm/sec;

a hole extending into a material to be broken by the bulk energetic material; and a stemming material positioned between the cartridge and an opening of the hole, the stemming material impeding the escape from the hole of gas released by the bulk energetic material after initiation thereof.

2. A small charge breaking system according to claim 1, wherein the bulk energetic material is a propellant.

3. A small charge breaking system according to claim 2, wherein the propellant is selected from the group consisting of nitrocelluose, nitroguanadine, sodium nitrate, ammonium nitrate, and mixtures thereof.

4. A small charge breaking system according to claim 1, wherein the high energy igniter is disposed in a portion of the bulk energetic material positioned in a middle section of the housing and spaced from opposing ends of the cartridge.

5. A small charge breaking system according to claim 1, wherein the housing has a yield strength of at least about 500 psi and can withstand external pressures of up to about 25 psi.

6. A small charge breaking system according to claim 1, wherein the high energy igniter includes a pyrotechnic material, and is free of primary and secondary energetic materials.

7. A small charge breaking system according to claim 1, wherein the stemming material is at least one of a consolidated material and an unconsolidated material.

8. A small charge breaking method, comprising:

providing a cartridge including:

a housing;

a bulk energetic material contained in the housing, the bulk energetic material filling at least most of the volume enclosed by the housing; and a high energy igniter operatively disposed relative to the bulk energetic material such that the igniter can initiate the bulk energetic material, wherein the high energy igniter, after initiation, releases a total of energy of at least about 400 joules per millisecond and wherein the bulk energetic material, after initiation, releases an amount of energy of no more than about 1 megajoules per kg of energetic material per millisecond;

inserting the cartridge into a hole extending into a material to be broken by the bulk energetic material;

inserting a stemming material into the hole such that the stemming material is positioned between the cartridge and an opening of the hole, the stemming material impeding the escape from the hole of gas released by the bulk energetic material after initiation thereof; and igniting the igniter to cause initiation of the bulk energetic material.

9. A small charge breaking method according to claim 8, wherein the bulk energetic material is a mixture of ammonium nitrate and a double based propellant.

10. A small charge breaking method according to claim 8, wherein the bulk energetic material is selected from the group consisting of nitrocellulose, nitroguanadine, sodium nitrate, ammonium nitrate, and mixtures thereof.

11. A small charge breaking method according to claim 8, wherein the high energy igniter includes a pyrotechnic material, and is free of primary and secondary energetic materials.

12. A small charge breaking method according to claim 8, wherein at least one of the ends of the housing is radiussed.

13. A small charge breaking method according to claim 8, wherein the stemming material is at least one of a consolidated material and an unconsolidated material.

14. A small charge breaking method according to claim 8, wherein the high energy igniter is disposed in a portion of the bulk energetic material positioned in a middle section of the housing and spaced from opposing ends of the cartridge.

15. A small charge breaking system according claim 1, wherein the housing comprises at least one end cap and the at least one end cap is tapered away from a body of the housing.

16. A small charge breaking system according to claim 15, wherein a peripheral edge of the end cap is arcuate in cross-section.

17. A small charge breaking system according to claim 15, wherein the at least one end cap defines a frustoconical surface.

18. A small charge breaking system according to claim 1, wherein the housing comprises a longitudinal groove extending at least substantially the entire length of the housing for receiving an activator to the high energy igniter.

19. A small charge breaking system according to claim 1, wherein an end cap of the housing comprises a groove wrapping around the end cap.

20. A small charge breaking system according to claim 19, wherein the end cap comprises an entry hole that is located off-center relative to the longitudinal center axis of the cartridge.

21. A small charge breaking system according to claim 20, wherein a pliable, water resistant seal is positioned in the entry hole.

22. A small charge breaking system according to claim 1, wherein the housing comprises at least one end cap threaded onto the housing.

23. A small charge breaking system according to claim 1, further comprising a second cartridge positioned adjacent to the cartridge and a joinder sleeve located between and engaging simultaneously the cartridges.

24. A small charge breaking method according to claim 8, wherein the housing comprises at least one end cap and the at least one end cap is tapered away from a body of the housing.

25. A small charge breaking method according to claim 24, wherein a peripheral edge of the end cap is arcuate in cross-section.

26. A small charge breaking method according to claim 24, wherein the at least one end cap defines a frustoconical surface.

27. A small charge breaking method according to claim 8, wherein the housing comprises a longitudinal groove extending at least substantially the entire length of the housing for receiving an activator to the high energy igniter.

28. A small charge breaking method according to claim 8, wherein an end cap of the housing comprises a groove wrapping around the end cap.

29. A small charge breaking method according to claim 28, wherein the end cap comprises an entry hole that is located off-center relative to the longitudinal center axis of the cartridge.

30. A small charge breaking method according to claim 29, wherein a pliable, water resistant seal is positioned in the entry hole.

31. A small charge breaking method according to claim 8, wherein the housing comprises at least one end cap threaded onto the housing.

32. A small charge breaking method according to claim 8, further comprising a second cartridge positioned adjacent to the cartridge and a joinder sleeve located between and engaging simultaneously the cartridges.

33. A small charge breaking system according to claim 1, wherein the bulk energetic material, after initiation, releases an amount of energy of no more than about 1 megajoules per kg of energetic material per millisecond.

* * * * *